US007540240B2

(12) United States Patent
Carlier et al.

(10) Patent No.: US 7,540,240 B2
(45) Date of Patent: Jun. 2, 2009

(54) PROTECTION DEVICE FOR MILITARY OR CIVILIAN VEHICLES AGAINST MAGNETIC DETECTION MINES

(75) Inventors: Sylvain Carlier, Guyancourt (FR); Benoit Pizon, Villiers le Bacle (FR)

(73) Assignee: Giat Industries, Versailles (FR)

( * ) Notice: Subject to any disclaimer, the term of this patent is extended or adjusted under 35 U.S.C. 154(b) by 372 days.

(21) Appl. No.: 11/658,184

(22) PCT Filed: Jun. 8, 2005

(86) PCT No.: PCT/FR2005/001407

§ 371 (c)(1),
(2), (4) Date: Jan. 23, 2007

(87) PCT Pub. No.: WO2006/021630

PCT Pub. Date: Mar. 2, 2006

(65) Prior Publication Data

US 2008/0314279 A1 Dec. 25, 2008

(30) Foreign Application Priority Data

Jul. 23, 2004 (FR) ..... 04 08212

(51) Int. Cl.
*F41H 11/00* (2006.01)

(52) U.S. Cl. ..... 102/402; 89/36.08; 335/301

(58) Field of Classification Search ..... 102/402; 89/36.08; 335/301
See application file for complete search history.

(56) References Cited

U.S. PATENT DOCUMENTS 5,458,063 A 10/1995 Laine et al.
2003/0010189 A1 1/2003 Zonak

FOREIGN PATENT DOCUMENTS

DE 3424231 A1 1/1986
DE 196 05 230 A1 8/1997

*Primary Examiner*—Ramon M Barrera
(74) *Attorney, Agent, or Firm*—Oliff & Berridge, PLC

(57) ABSTRACT

A protection device for land vehicles against mines, wherein it incorporates a metallic plate positioned under the vehicle so as to normalize the magnetic field generated by the vehicle and/or by its elements and at least one loop positioned under the metallic plate and made of an electrically conductive material connected to an electrical supply so as to generate a magnetic field of a value substantially equal to the opposing sign of the magnetic field from the vehicle so as to render said vehicle undetectable by magnetic detection mines.

9 Claims, 1 Drawing Sheet

PROTECTION DEVICE FOR MILITARY OR CIVILIAN VEHICLES AGAINST MAGNETIC DETECTION MINES

BACKGROUND OF THE INVENTION

1. Field of the Invention

The technical scope of the present invention is that of protection devices for land vehicles, and more particularly protection devices against magnetic detection mines.

2. Description of the Related Art

The use of mines during conflicts is widespread nowadays and constitutes a relatively inexpensive means, which is simple to use and particularly destructive, namely for the protection of a delimited zone or to hinder the advance of an army. The mine thus constitutes an omnipresent but furtive threat which, in most conflicts, constitutes one of the principle factors in the loss of human lives and property.

The threat constituted by mines is largely diversified. Two main types of mines can be distinguished according to the intended target (personnel or vehicles) which themselves encompass separate families depending on the mode of aggression. In the domain of anti-vehicle mines, different modes of triggering may be distinguished. The most common are those triggered by pressure, tilting, with trip wires, magnetic detectors, seismic detectors or infra-red detectors.

For vehicles likely to be travelling into mined areas, in particular military or demining vehicles, it is essential that they be protected against such mines and more particularly against magnetic detection mines which are used more and more frequently.

One solution consists in increasing the protection of the vehicle by increasing the thickness of the vehicle floor pan, by positioning a caisson under the vehicle body which has a high potential for deformation or by profiling the bottom of the vehicle body so as to deviate the blast of the explosion, but these solutions considerably increase the vehicle's mass. Moreover, however efficient they may be, such protections protect the vehicle against a first explosion but are unable to protect it against successive explosions. Moreover, the explosion of a mine reveals the presence of a vehicle which may thereafter be easily located by the enemy.

Another solution consists in using amagnetic materials to manufacture the vehicle, but such materials are particularly onerous. Moreover, certain vehicle elements, for example the engine, cannot be produced using such materials.

SUMMARY OF THE INVENTION

The aim of the present invention is to supply an effective protection device for a vehicle against magnetic detection mines, which is light, takes up little space, is easy to manufacture, is relatively inexpensive, can be integrated into an existing structure and enables the magnetic signature of the vehicle to be eliminated or at least heavily reduced, so as to render the vehicle undetectable by magnetic detection mines.

The invention thus relates to a protection device for land vehicles against mines, characterised in that it incorporates a metallic plate positioned under the vehicle so as to normalise the magnetic field generated by the vehicle and/or by its elements and at least one loop positioned under the metallic plate and made of an electrically conductive material connected to an electrical supply so as to generate a magnetic field of a value substantially equal to the opposing sign of the magnetic field from the vehicle so as to render said vehicle undetectable by magnetic detection mines.

According to one characteristic, the device also incorporates a calculator cooperating with a modulator so as to modulate the electrical current circulating in at least one loop according to the variation in the vehicle's own magnetic field, in the variation in the magnetic fields generated by its elements or in the resultant magnetic field of the vehicle equipped with said device.

According to another characteristic, the device incorporates position sensors enabling the position of the vehicle to be detected and namely its position and/or orientation with respect to the terrestrial magnetic force.

According to yet another characteristic, the device incorporates magnetic field sensors enabling the resultant magnetic field of the vehicle equipped with said device to be measured.

According to another characteristic, the plate is a plate of steel between 1 and 100 mm thick.

According to another characteristic, the device incorporates several loops supplied by different electrical currents so as to generate several superimposed magnetic fields.

A first advantage of the device according to the invention lies in the fact that it enables the explosion of magnetic detection mines to be avoided, thereby also avoiding the damage caused to the vehicles and any injuries to the vehicle crew.

Another advantage lies in the fact that it enables the explosion of magnetic detection mines to be avoided, thereby preventing the vehicle from being located.

Another advantage lies in the fact that it takes up relatively little space and may be easily put into place in addition to an existing structure.

Another advantage lies in the compatibility of the device with other passive protection devices and namely devices for protection against blast-effect mines.

Another advantage lies in the possibility of having a counter reaction in close proximity.

BRIEF DESCRIPTION OF THE DRAWINGS

Other characteristics, particulars and advantages of the invention will become more apparent from the following description, given by way of illustration and with reference to the drawings, in which.

DETAILED DESCRIPTION OF THE PREFERRED EMBODIMENT

Figure 1:
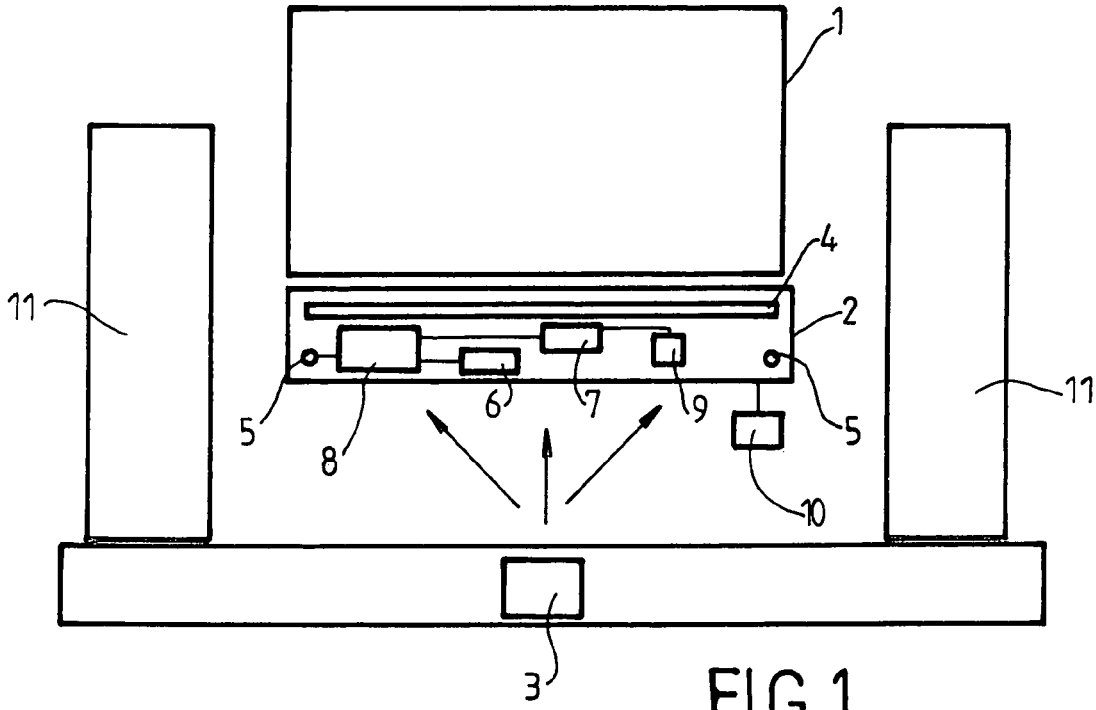
FIG. 1 schematically shows a vehicle equipped with a device according to the invention and FIG. 2 schematically shows a variant embodiment of the invention.

FIG. 1 shows a vehicle 1, for example a wheeled military vehicle, equipped with a device 2 according to the invention. The protection device against magnetic detection mines is here in the form of a caisson incorporating a metallic plate arranged horizontally under the vehicle body 1 arid an electric cable 5 arranged under the metallic plate and forming a substantially horizontal loop with a surface area substantially equal to that located between the wheels 11 of the vehicle 1 or only slightly less. The electric cable 5 is connected to an electrical supply 6 so as to generate a magnetic field. A modulator 8 linked to a calculator 7 enables the current flowing through the electric cable 5, and thus the magnetic field, generated to be varied.

The device functions as follows. The vehicle 1, because of its metallic mass and its different elements (motor, fit-up, etc) generates an irregular magnetic field likely to trigger magnetic detection mines. The aim is therefore to even out this magnetic field and to cancel it, or at least reduce it heavily, so as to render said vehicle undetectable by magnetic detection mines.

The plate 4 is made of, a magnetic material, for example sheet steel, so as to even out the magnetic field generated by the vehicle 1 and/or by its elements. In the loop 5 made of an electrically conductive material (here a cable) a current is made to circulate so as to generate a magnetic field of a value substantially equal and of the opposing sign to the magnetic field from the vehicle 1. The role of the calculator 7 is thus to determine the characteristics of the current to be applied according to data such as the position of the vehicle with respect to the terrestrial magnetic field or the values of the magnetic fields monitored either between the vehicle body and the loop 5, or downstream of the device. To know this different data, the detectors already present on the vehicle may be used (terrestrial magnetic field sensors, GPS, etc) or sensors can be integrated into the device (for example position sensors enabling the position of the vehicle to be known and namely its position and/or its orientation with respect to the terrestrial magnetic field, or magnetic field sensors enabling the resultant magnetic field of the vehicle equipped with said device to be measured).

Figure 2:
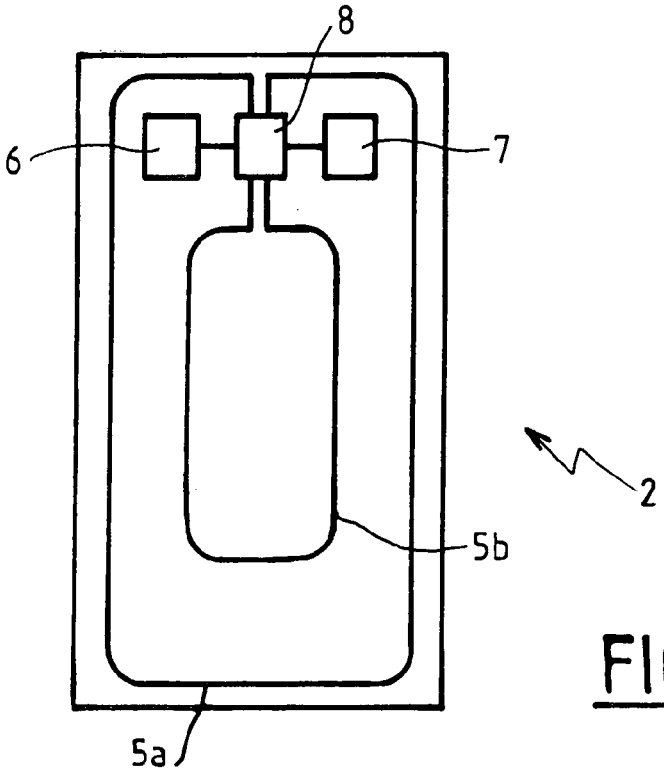

FIG. 2 schematically shows a variant embodiment of the invention in which the device incorporates two loops 5*a* and 5*b* of electric cable. The currents flowing through these two loops are generated by the electrical supply 6 and modulated by the modulator 8 but remain separated from one another. The magnetic field generated by the device is equal to the sum of the magnetic fields generated by each loop. In this variant embodiment, the calculator 7 breaks down the magnetic field to be generated into two fields, respectively applied by each loop, and pilots the modulator so as to supply each loop according to the magnetic field to, be generated. Generally speaking, the invention may be made using a multitude of loops so as to generate a magnetic field exactly opposing that of the vehicle and thereby able to completely cancel out the vehicle's magnetic signature.

When the device is being mounted onto a vehicle that already possesses anti-mine protection in the form of metallic reinforcements, such reinforcement may advantageously be used in replacement of the metallic plate. Similarly, this device may advantageously be positioned inside a non-magnetic protection caisson, for example one made of composite materials or aluminium.

The device may also advantageously be fixed to a vehicle adjustable in height so that the loop may be positioned more or less closely to the ground. Such an embodiment enables the adjustment of the currents to be optimised thereby providing an effective counter-reaction in close proximity.

The invention claimed is:

1. A protection device for a land vehicle against mines, wherein said device incorporates a metallic plate positioned under said vehicle so as to normalize the magnetic field generated by said vehicle and/or by the components of said vehicle and at least one loop positioned under said metallic plate and made of an electrically conductive material connected to an electrical supply so as to generate a magnetic field of a value substantially equal to the opposing sign of the magnetic field from said vehicle so as to render said vehicle undetectable by magnetic detection mines.

2. A device according to claim 1, wherein said plate is a plate of steel between 1 and 100 mm thick.

3. A device according to claim 1, wherein said device incorporates several loops supplied by different electrical currents so as to generate several superimposed magnetic fields.

4. A device according to claim 1, wherein said device also incorporates a calculator cooperating with a modulator so as to modulate the electrical current circulating in said at least one loop according to the variation in the own magnetic field of said vehicle, in the variation in the magnetic fields generated by said components or in the resultant magnetic field of said vehicle equipped with said device.

5. A protection device against mines according to claim 4, wherein said device incorporates position sensors enabling the position of said vehicle to be detected and namely the position and!or orientation of said vehicle with respect to the terrestrial magnetic force.

6. A protection device against mines according to claim 5, wherein said device incorporates magnetic field sensors enabling the resultant magnetic field of said vehicle equipped with said device to be measured.

7. A protection device against mines according to claim 4, wherein said device incorporates magnetic field sensors enabling the resultant magnetic field of said vehicle equipped with said device to be measured.

8. A device according to claim 4, wherein said plate is a plate of steel between 1 and 100 mm thick.

9. A device according to claim 4, wherein said device incorporates several loops supplied by different electrical currents so as to generate several superimposed magnetic fields.

* * * * *